US005511727A

United States Patent [19]

Heren et al.

[11] Patent Number: 5,511,727

[45] Date of Patent: Apr. 30, 1996

[54] WAVE SPRINKLER WITH IMPROVED ADJUSTABLE SPRAY ASSEMBLY

[75] Inventors: Lawrence P. Heren; Jerry R. Hayes, both of East Peoria, Ill.; Thomas R. Kruer, Edgewood, Ky.

[73] Assignee: L. R. Nelson Corporation, Peoria, Ill.

[21] Appl. No.: 252,555

[22] Filed: Jun. 1, 1994

[51] Int. Cl.[6] ..... B05B 3/16; B05B 1/16

[52] U.S. Cl. ..... 239/242; 239/248; 239/263; 239/390; 239/556; 239/562; 239/DIG. 1

[58] Field of Search ..... 239/242, 240, 239/237, 263, 559, 557, 556, 562, DIG. 1, 566, 552, 550, 390, 248

[56] References Cited

U.S. PATENT DOCUMENTS

| | | | |
|---|---|---|---|
| 615,486 | 12/1898 | Jendis | 239/566 X |
| 1,517,664 | 12/1924 | Bergquist | 239/242 |
| 3,423,024 | 1/1969 | Morawetz | 239/242 |
| 3,434,522 | 3/1969 | Laurenty | 239/566 X |
| 3,599,877 | 8/1971 | Goldschmied | 239/566 X |
| 3,647,140 | 3/1972 | Perrot et al. | 239/242 |
| 3,827,637 | 8/1974 | Stephany et al. | 239/242 |
| 5,052,622 | 10/1991 | Lindermeir et al. | 239/242 |
| 5,098,020 | 3/1992 | Cooper et al. | 239/242 X |
| 5,305,956 | 4/1994 | Wang | 239/DIG. 1 X |
| 5,335,855 | 8/1994 | Borod | 239/566 X |
| 5,350,115 | 9/1994 | Burnworth et al. | 239/DIG. 1 X |

FOREIGN PATENT DOCUMENTS

| | | | |
|---|---|---|---|
| 47444 | 3/1982 | European Pat. Off. | 239/242 |
| 2135012 | 12/1972 | France . | |
| 536769 | 10/1931 | Germany . | |
| 2444664 | 9/1974 | Germany . | |

*Primary Examiner*—Andres Kashnikow
*Assistant Examiner*—Lesley D. Morris
*Attorney, Agent, or Firm*—Keck, Mahin & Cate

[57] ABSTRACT

A wave sprinkler assembly in which the tubular spray assembly comprises a tubular member and one or more elongated strips of flexible material having a series of longitudinally spaced water stream outlets extending therethrough, the strips are assembled with the tubular member by inserting them therein through an end and moving them radially outwardly into an operative position wherein the water under pressure within the interior of the tubular spray assembly acts on the strips to enhance their engagement with the tubular member. The strip provides an annular seal of flexible sealing material extending around the exterior of each of the controllable water stream outlets, and a control member is mounted on the elongated tubular assembly for movement between a full width operating position and a width limiting position. The control member includes a control section associated with each annular seal and the controllable water stream outlet around which it extends. Each control section has a surface area movable into engagement with the associated annular seal to prevent a water stream from issuing from the controllable water stream outlet around which it extends and an open area movable over the controllable water stream outlet around which the associated annular seal extends to allow a water stream to issue therefrom.

14 Claims, 7 Drawing Sheets

WAVE SPRINKLER WITH IMPROVED ADJUSTABLE SPRAY ASSEMBLY

This invention relates to lawn sprinklers and more particularly to lawn sprinklers of the wave type.

Wave type sprinklers are well known in the commercial market. They are popular lawn sprinklers because of the large coverage areas and the ability to be adjusted to accommodate different coverage areas. Typically, wave type lawn sprinklers provide a tubular spray head which is oscillated about an axis which extends generally in the direction of elongation. Typically, the tubular spray head is constructed of a tube, usually of aluminum, which has a central portion bent upwardly into an arch-like configuration. Spaced outlet openings are formed along the upper surface of the central arched portion so that when the interior of the tube is filled with water under pressure, the water issues from the outlet openings as a series of water streams in a generally fan-shaped configuration.

One problem which is presented by the conventional construction of the tubular spray head is in the formation of the outlet openings. In the more economical constructions, the openings are simply holes drilled or otherwise formed in the tube. In the more involved constructions, individual jet nozzle elements are installed in the tube wall. Clearly, a separate element which is formed with an efficient nozzle configuration is capable of creating a more desirable jet spray than a simple hole drilled in the wall of a tube.

U.S. Pat. No. 3,827,637 discloses a proposed construction for achieving the advantages of a formed nozzle surface at a cost less than that required to install each jet nozzle element separately. The '637 patent proposes to form all of the nozzle elements at one time by molding the entire series of plastic in a strip form. The strip arrangement is particularly desirable because the individual nozzles can be formed with varying angles enabling a fan-shaped jet stream configuration to be produced while utilizing a straight tube without a centrally arched portion, thus reducing costs. A problem with the configuration disclosed is that it is necessary to install the nozzle strip in the tube from the exterior of the tube. The disclosure indicates that the securement is preferably a wedging securement but that it can be by a snap action construction. In either case, the pressure of the water within the tube acts on the wedged or snap action portion of the strip in a direction to dislodge the strip. Moreover, with the major portion of the strip exposed exteriorly of the tube, the strip was susceptible to accidental dislodgement during the rough handling to which sprinklers are sometimes subjected. There is a need to provide an improved tubular spray head which overcomes the problems noted above.

An object of the present invention is to fulfill the need expressed above. In accordance with the principles of the present invention, this objective is achieved by providing a housing and base assembly which provides a water inlet for communication with a source of water under pressure and an outlet communicating with the inlet. A tubular spray assembly is mounted on the housing and base assembly for oscillatory movement with respect thereto. The tubular spray assembly has an inlet end disposed in sealed water communicating relation with the outlet so that an interior of the tubular spray assembly receives water under pressure from the outlet. The opposite end is closed and a series of longitudinally spaced water stream outlets are disposed between the inlet end and the closed end. A water pressure actuated oscillating mechanism is carried by the housing and base assembly between the water inlet and the outlet and constructed and arranged to oscillate the tubular spray assembly when the water inlet is communicated with a source of water under pressure. The tubular spray assembly includes a tubular member and an elongated strip of flexible material which has a number of the series of longitudinally spaced water stream outlets extending therethrough. The tubular member includes an elongated section which has transverse opening-defining and interior strip-engaging surfaces thereon. The strip has interior pressure responsive and exterior mounting surfaces therein which are constructed and arranged so that when the strip is inserted within the tubular member through an end thereof and moved radially outwardly into an operative position with respect to the elongated section of the tubular member the interior pressure responsive and exterior mounting surfaces of the strip are engaged respectively (1) by the water under pressure within the interior of the tubular spray assembly and (2) by an interior strip-engaging surface of the tubular member so that engagement of the water under pressure with the strip enhances engagement of the strip with the tubular member. Each water stream outlet in the strip extends within an opening in the tubular member defined by an opening-defining surface of the tubular member so that water under pressure within the interior of the tubular spray assembly issues from the series of longitudinally spaced water stream outlets as a series of longitudinally spaced water streams which oscillate as the tubular spray assembly is oscillated to provide a desired sprinkler pattern on a ground area to be sprinkled.

There have been many proposals disclosed in prior art patents for building into the tubular spray head assembly of a wave sprinkler-the capability of varying the width size of the fan-shaped jet streams issuing from the outlet openings of the tubular spray head assembly. Examples of patents containing several different proposals are as follows: U.S. Pat. Nos. 1,517,664, 3,423,024, and 5,052,622. See also French patent 2,135,012 and German Patent Nos. 536,769 and 2,444,664. There is always a need to provide the above variation by a construction which is more cost effective.

Another object of the present invention is to fulfill the need for a more cost effective construction of the type referred to above. In accordance with the principles of the present invention, this objective is obtained by providing a housing and base assembly which provides a water inlet for communication with a source of water under pressure and an outlet communicating with the inlet. A tubular spray assembly is mounted on the housing and base assembly for oscillatory movement with respect thereto. The tubular spray assembly includes an inlet disposed in sealed water communicating relation with the outlet so as to supply an interior of the tubular spray assembly with water under pressure. A water pressure actuated oscillating mechanism is carried by the housing and base assembly between the water inlet and the outlet and is constructed and arranged to oscillate the tubular spray assembly when the water inlet is communicated with a source of water under pressure. The tubular spray assembly provides a series of water stream outlets constructed and arranged to have water under pressure supplied to the interior of the tubular spray assembly issue therefrom into a series of water streams which are oscillated to produce a desired water pattern on the ground to be sprinkled having a width determined by water stream outlets at the ends of the series. The water stream outlets include a plurality of controllable water stream outlets at one end of the series. An annular seal of flexible sealing material extends around the exterior of each of the controllable water stream outlets. A control member is mounted on the tubular spray assembly for movement with respect to the tubular spray assembly in opposite directions between a full width operating position and a width limiting position. The control member includes a control section associated with each annular seal and the controllable water stream outlet which it extends around. Each control section extends in the direction of movement of the control member and has a surface area movable into engagement with the associated annular seal to prevent a water stream from issuing from the controllable water stream outlet around which it extends and an open area movable over the controllable water stream outlet around which the associated annular seal extends to allow a water stream to issue therefrom.

While it is within the contemplation of the present invention in its broadest aspects to provide a separate annular seal for each opening, preferably the annular seals are formed as an integral part of a molded nozzle strip of the type previously described. In its broadest aspects, the present invention contemplates a single molded nozzle strip, while a preferred construction provides two strips which are mirror images of one another, each of which is capable of being formed in the same mold. The preferred twin nozzle strip construction makes the interior mounting within a single spray tube easier.

It will be understood that, while it is preferable to combine the spray width varying feature with the nozzle strip feature, each has applicability alone in existing wave sprinklers.

These and other objects of the present invention will become more apparent during the course of the following detailed description and appended claims.

The invention may best be understood with reference to the accompanying drawings wherein an illustrative embodiment is shown.

IN THE DRAWINGS

Figure 1:
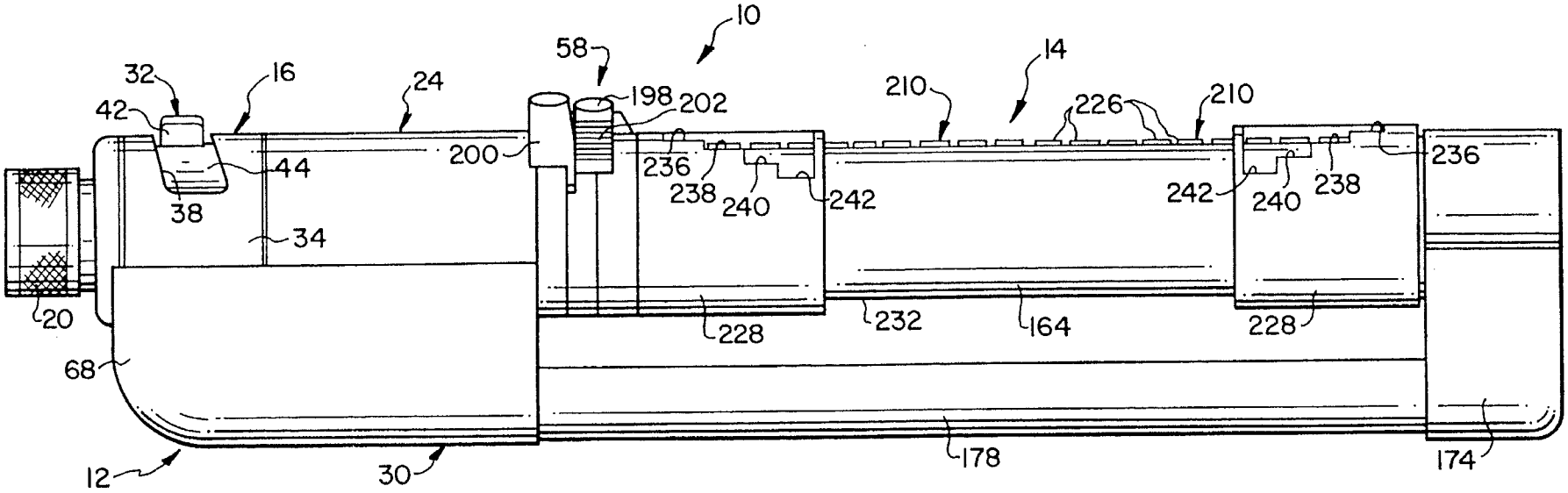
FIG. 1 is a side elevational view of a wave sprinkle embodying the principles of the present invention.
Figure 2:
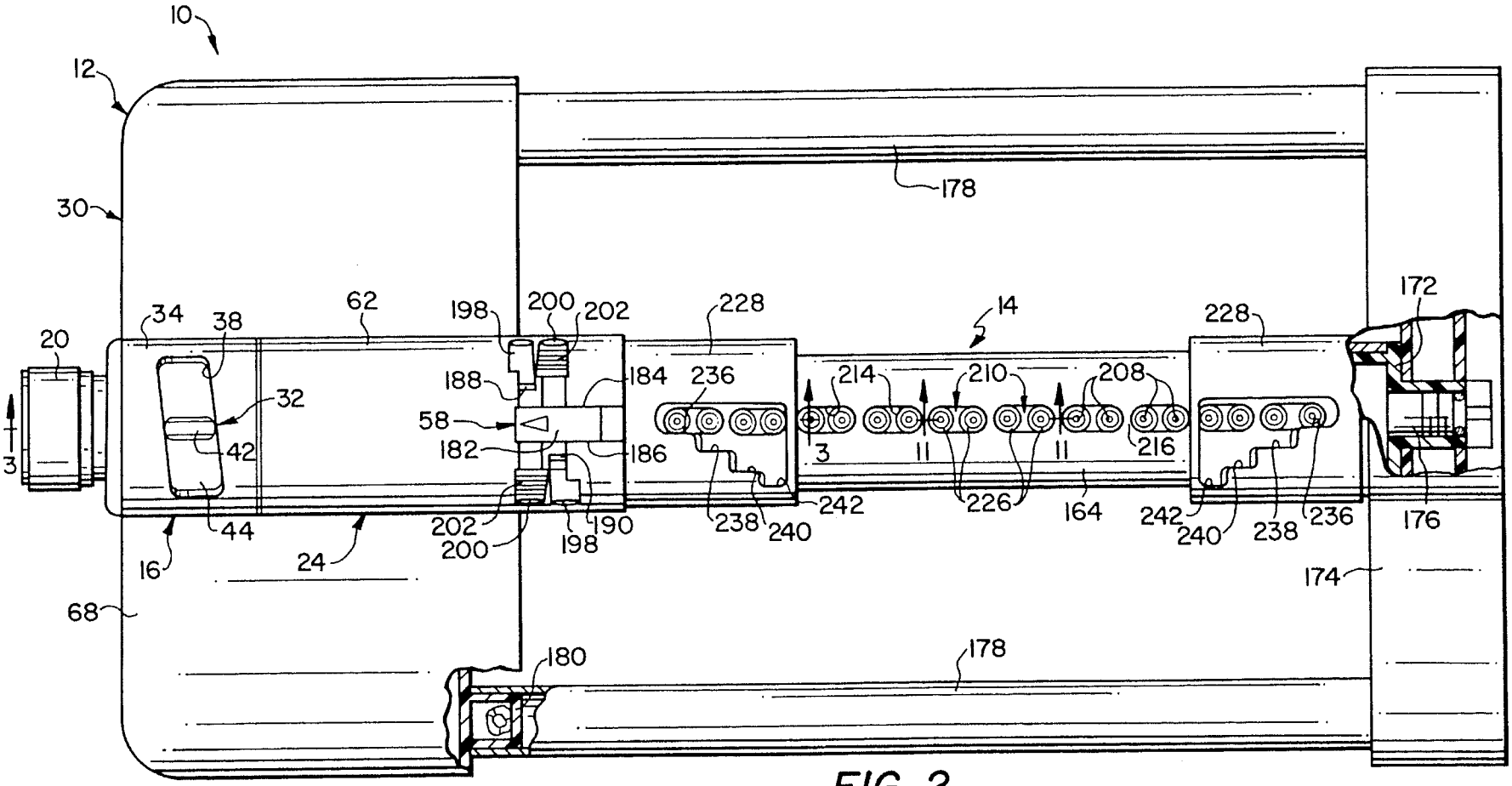
FIG. 2 is a top plan view of the wave sprinkler with parts broken away for purposes of clear illustration
Figure 3:
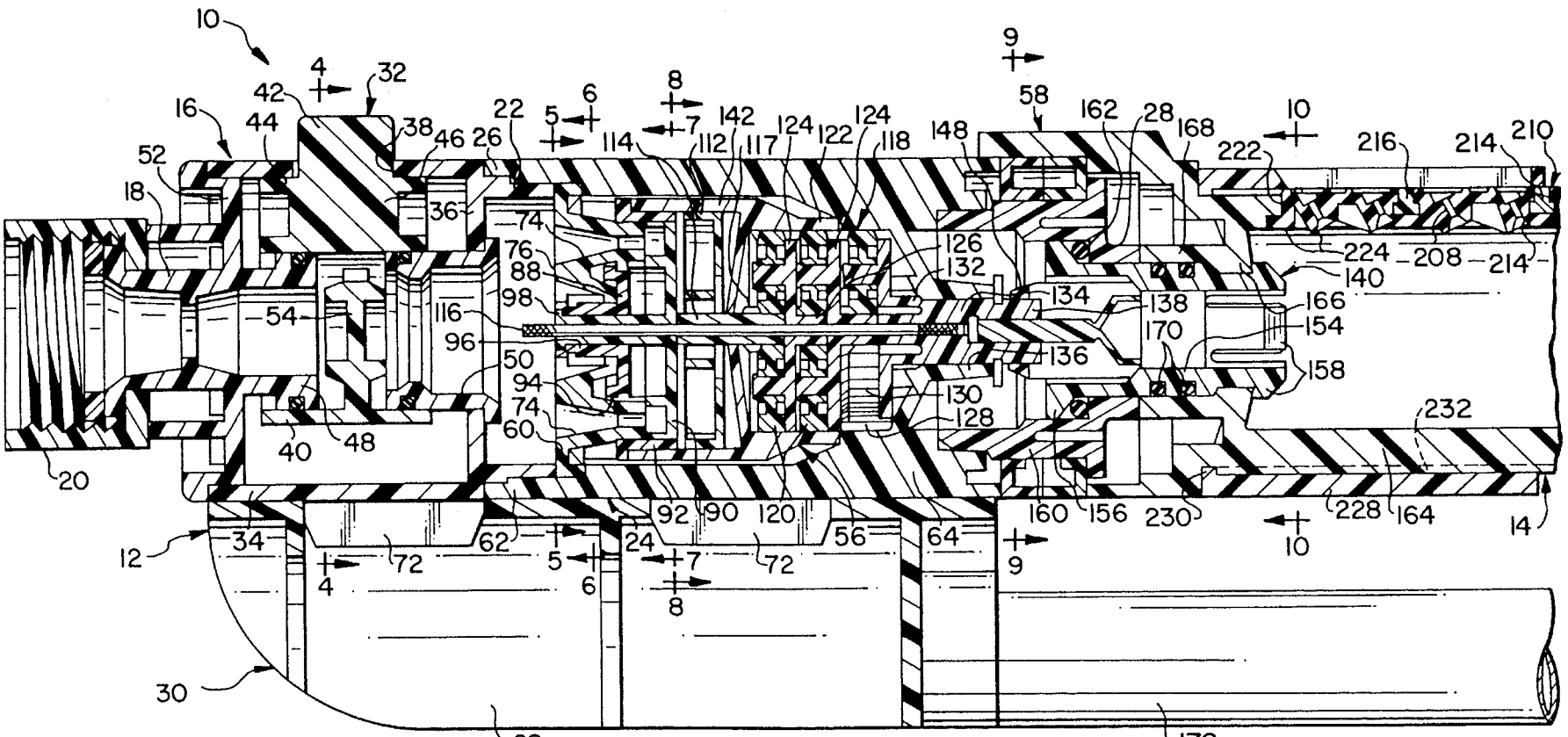
FIG. 3 is an enlarged fragmentary sectional view taken along the line 3—3 of FIG. 2.

Referring now more particularly to FIGS. 1–3 of the drawings, there is shown therein a wave sprinkler, generally indicated at 10, which embodies the principles of the present invention.

The wave sprinkler 10 includes in general a housing and base assembly, generally indicated at 12, and a tubular sprinkler assembly or spray head assembly, generally indicated at 14, mounted on the base and housing assembly 12 for movement about an oscillatory axis through repeated oscillating cycles, each of which includes a forward stroke in one direction and a return stroke in the opposite direction.

In the preferred embodiment shown, the housing and base assembly 12 includes three subassemblies. First, a first housing assembly, generally indicated at 16, which includes an inlet 18 at one end having a conventional female hose coupling element 20 connected thereto and an outlet 22 at its opposite end. Second, a second housing assembly, generally indicated at 24, which includes an inlet 26 disposed in water communicating relation with respect to the outlet 22 of the first housing assembly 16 and an outlet 28 which communicates with an inlet end of the tubular sprinkler head assembly 14. The third subassembly component is a base assembly, generally indicated at 30. The base assembly 30 has a fixed snap action connection with the first and second housing assemblies 16 and 24, respectively.

Mounted within the first housing assembly 16 is a manually adjustable control mechanism, generally indicated at 32. The control mechanism 32 is optional and may be omitted if desired. The control mechanism 32, when utilized, can be any type of manually adjustable control mechanism such as a timing device which is operable when initially set to allow a source of water under pressure to flow from the inlet 18 to the outlet 22 of the first housing assembly 16 and after a manually selected predetermined time has passed to discontinue the flow of water from the inlet 18 to the outlet 22. As shown, however, the manually adjustable control mechanism 32 is in the form of a flow control assembly.

As best shown in FIGS. 1–4, the first housing assembly 16 includes a cylindrical peripheral housing wall 34 having an open inlet end and an annular wall 36 extending inwardly from an outlet end thereof. Formed in a central upper portion of the peripheral wall 34 is a cam slot 38. The cam slot 38 is configured to extend from one end thereof peripherally to an opposite end thereof and be displaced axially from the first end a distance substantially less than the peripheral distance between the ends thereof. As shown, the configuration is helical. The flow control mechanism 32 is in the form of unitary movable flow control structure which includes a central movable cylindrical wall 40 and a digitally engageable handle 42. The handle 42 is oriented axially and is disposed in radially outwardly extending relation from the axis of the movable central cylindrical wall 34. Extending outwardly from the end of the handle 42 opposite from its free end is a cylindrical wall section 44 which has a shape sufficient to slidably engage the interior surface of the peripheral wall 34 and cover cam slot 38. Appropriate reinforcing ribs 46 extend between the cylindrical wall section 44 and the adjacent exterior of the movable cylindrical wall 40.

The flow control mechanism 32 is assembled in movable operative relation within the first housing assembly 16 by moving the same axially through the open inlet end of the peripheral wall 34 and then moving the same transversely in the direction of the handle 42 to move the handle 42 through the cam slot 38 and interengage the exterior surface of the cylindrical wall section 44 with the interior surface of the peripheral housing wall 34. It will be understood that the dimension from the free end of the handle 42 to the opposite end of the movable cylindrical wall 40 is less than the interior dimension of the peripheral wall 34. The size of the handle 42 is such that its axial dimension just fits within the cam slot 38 so that as the handle 42 is moved peripherally it is guided for axial movement. The size of the cylindrical section 44 is such as to close the cam slot 38 interiorly in any position of movement of the handle.

The flow control mechanism 32 is supported for oscillatory movement about the axis of the cylindrical peripheral wall 34 by inlet and outlet cylindrical walls 48 and 50 forming a part of the first housing assembly 16 and disposed in sealed telescoping relation with respect to inlet and outlet portions of the movable cylindrical wall 40 respectively. The inlet cylindrical wall 48 forms a part of an inlet housing member providing the inlet 18 and includes an annular wall 52 which extends outwardly from the inlet cylindrical wall 48 and is fixed, as by plastic welding or the like, in closing relation to the open inlet end of the peripheral wall 34.

The outlet cylindrical wall 50 extends through the outlet annular wall 36 at the outlet end of the peripheral wall 34 and has an outwardly extending flange on the upstream end thereof which is fixed, as by welding or gluing to the annular wall 36. As shown, the inlet and outlet cylindrical walls 48 and 50 extend telescopically within the movable central wall 40, although the reverse arrangement could be provided. As shown, each of the inlet and outlet cylindrical walls 48 and 50 are formed with exterior annular grooves for receiving an O-ring seal which ensures a liquid tight telescopic relationship between the three cylindrical walls 48, 40 and 50.

Figure 4:
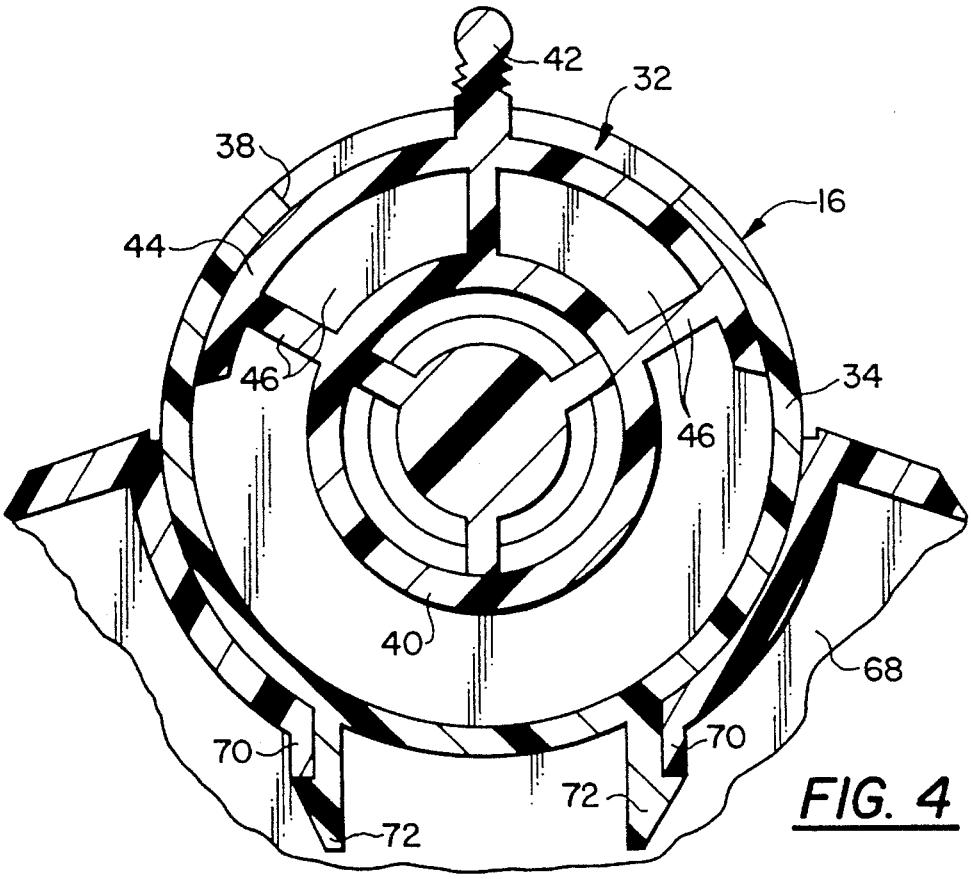
FIG. 4 is an enlarged fragmentary sectional view taken along the line 4—4 of FIG. 3.

Formed integrally as part of the flow control mechanism 32 within the central portion of the movable cylindrical wall 40 is an annular flow control element 54. As best shown in FIG. 4, the flow control element 54 is retained in fixed relationship to movable cylindrical wall 40 by three integral ribs annularly spaced therearound. In the embodiment shown, the inner end of the inlet cylindrical wall 48 constitutes a second flow control element, although the outlet cylindrical wall could be utilized instead. It will be noted that as the handle 42 is moved peripherally within the cam slot 38, the cam slot serves to guide the flow control mechanism 32 axially. The configuration of the cam slot 38 and the engagement of the handle 42 therein are such as to resist movement of the flow control mechanism 32 axially by virtue of water pressure acting on the flow control element 54 tending to move the same toward the outlet. It will be understood that the arrangement is such that the flow control mechanism 32 will be retained in any position into which it is moved by manual digital manipulation of the handle 42. When the handle 42 is in a position against the end of the cam slot 38 closest to the inlet 18, the cooperation flow controller faces on the flow control element 54 and inner end of inlet cylindrical wall 48 are the closest together and a minimum flow is permitted. When the handle 42 is moved to the opposite end of the cam slot 38 the flow will be the greatest. The arrangement permits any selected flow rate between the minimum and maximum by simply moving the handle in a peripheral direction into the selected position where it will stay.

Mounted within the second housing assembly 24 is an oscillating mechanism in the form of a water jet and impeller reversing assembly, generally indicated at 56. The oscillating mechanism is constructed and arranged to be operable by the flow of water under pressure between the inlet 26 and outlet 28 of the second housing assembly 24 to move the sprinkler spray head assembly 14 through the repeated oscillating head cycles thereof during which water under pressure discharged from the sprinkler head assembly 14 is distributed in a predetermined pattern on the ground. Each of the oscillating head cycles includes a head stroke in one direction and a return head stroke in the opposite direction so that a corresponding dimension of the water pattern corresponds with the distance of the forward or reverse stroke of each head cycle. A stop system in the form of an adjusting mechanism, generally indicated at 58, is provided for adjusting the distance of the head stroke of each head cycle within a range between a minimum head stroke distance and a maximum head stroke distance so as to vary the corresponding dimension of the water pattern within a range between a minimum dimension and a maximum dimension. The adjustment also determines the position of the pattern with respect to the sprinkler itself.

Figure 5:
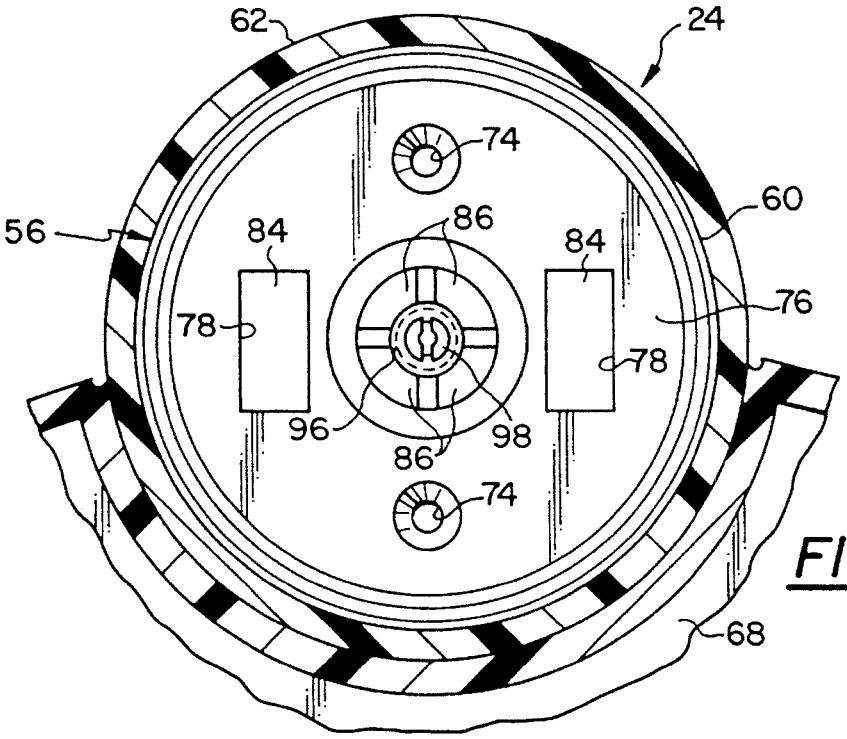
FIG. 5 is an enlarged fragmentary sectional view taken along the line 5—5 of FIG. 3.
Figure 6:
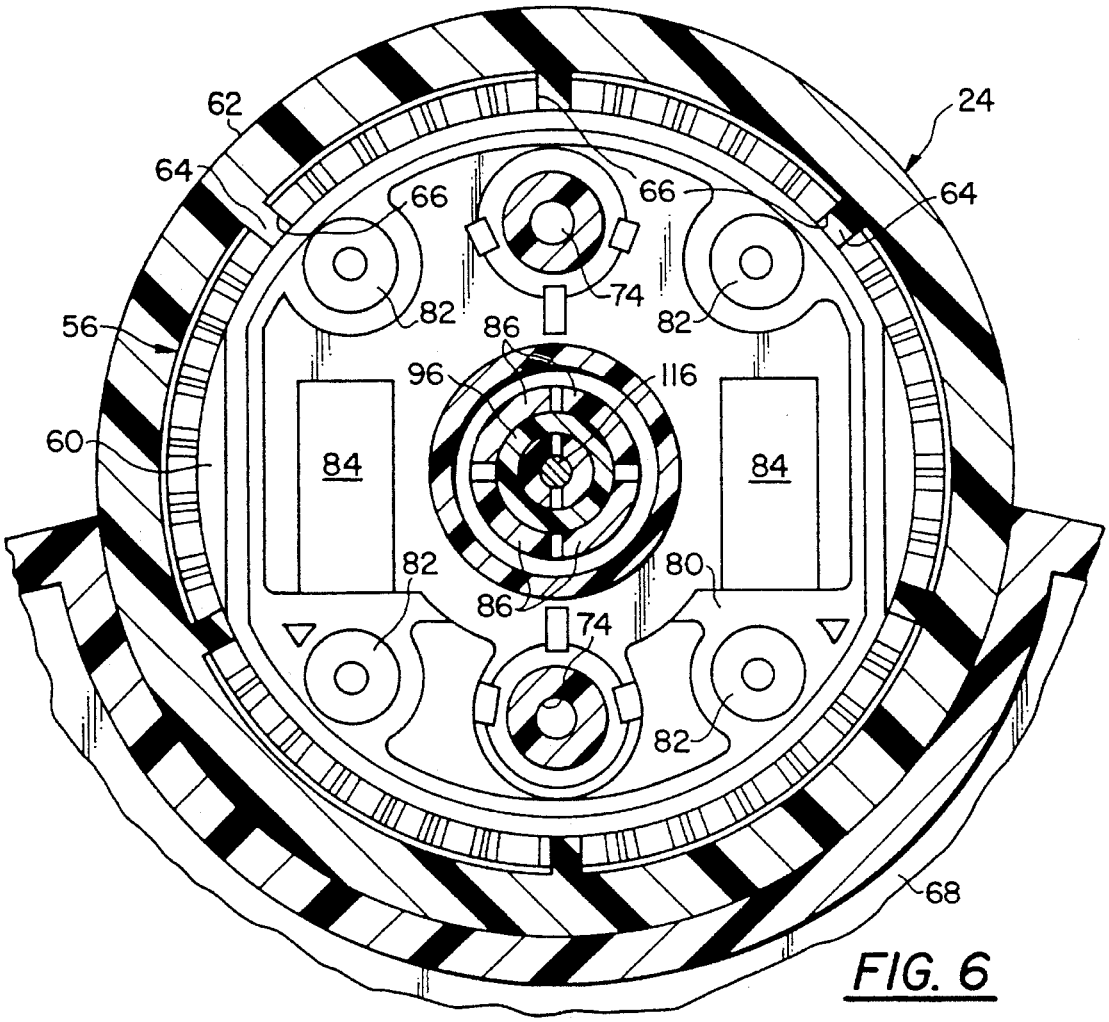
FIG. 6 is a greatly enlarged fragmentary sectional view taken along the line 6— 6 of FIG. 3.

As best shown in FIGS. 3, 5 and 6, the oscillating mechanism 56 includes an inlet end member 60 which is sized to be mounted within the open inlet end 26 of a peripheral housing wall 62 forming a part of the second housing assembly 24. Formed on the interior periphery of the housing wall 62 is a series of annularly spaced ribs 64 which end spaced from the inlet end 26 of the housing wall 62. The end member 60 includes an axially extending flange formed with a series of teeth which define troughs 66 therebetween. The end member 60 is fed into the open inlet end 26 of the housing wall 62 until the ends of the ribs 64 engage within registering troughs 66 between the teeth thus ensuring that the end member 60 is properly positioned and will not move in a rotational sense with respect to the housing wall 62. Preferably, the outlet 22 of the first housing assembly 14 is a generally short cylindrical wall that extends within the interior periphery of the inlet end 26 of the housing wall 62 into engagement with the end member 60 to retain the same in fixed relation axially within the housing wall 62. If desired, the outlet 22 of the first housing assembly 16 can be welded or otherwise secured to the inlet 26 housing wall 62 although this is not necessary since both peripheral walls are affixed to a common base member 68.

As best shown in FIGS. 3, 4, 7 and 8, base member 68 is of generally rectangular configuration in plan with a central axially extending depression of inverted arcuate configuration shaped to engage the lower portion of the two cylindrical housing walls 34 and 62. The arcuate depression of the base member 68 is formed with openings in the central portion thereof and the opposite sides of the openings are defined by downwardly extending flanges 70. Each of the housing walls 34 and 62 include barb-like extensions 72 formed integrally on the exterior periphery thereof which are adapted to move through an associated opening and snap under lower ends of the associated flanges 70. In this way the first and second housing assemblies 16 and 24 are retained in operative relation with one another and on the base member 68. It will be understood that housing wall 34 need not include extensions 72 in view of the fixed connection of the housing outlet wall 22 with the inlet 26 of the housing wall 62.

The end member 60 includes a pair of hollow frustoconical portions defining a pair of nozzles 74 which extend inwardly from a water-restricting surface 76 thereof facing the outlet 22 of the cylindrical wall 34. The interior surfaces of the nozzles 74 confine the flow of water under pressure into jet formations which issue from the nozzles 74 in an axial direction.

The end member 60 also includes a pair of rectangularly-shaped bypass openings 78 extending therethrough, best shown in FIG. 5. Fixed to the surface of the end member opposite from the surface 76 is a thin plastic structure 80 which is fixed thereto as by integral columns 82 on the member 60 extending through openings in the thin plastic element and fused thereover to effect a fixed securement. The thin plastic structure 80 includes two cantilevered flap valve elements 84 which cover the bypass openings 78 and normally prevent flow of water through the bypass openings 78. The flap valve elements 84 are capable of yielding to allow a bypass flow in instances where the pressure of the water confined by surface 76 reaches a predetermined above normal level. The end member 60 also includes a central hub structure which includes an outer frusto-conical wall extending from the surface 76 inwardly and a cylindrical wall extending outwardly from the inner end of the frusto-conical wall split to define arcuate sectors 86 terminating in an inwardly turned flange.

Mounted inwardly of the end member 60 are cooperating first and second movable members 88 and 90 which serve to initiate and accomplish the reversing function. The first movable member 88 is an annular member having a peripheral wall 92 extending axially inwardly from the periphery thereof with a flange extending outwardly from one end thereof. Formed in diametrically opposed relation within the first movable member 88 is a pair of vector shaped openings 94 which receive the inner ends of the nozzles 74. A sleeve or hub extends axially outwardly from the center of the first movable member 88, the sleeve 96 being formed with a peripheral groove. The sleeve 96 is capable of being moved into the arcuate sectors 86 with a snap action with the inner flanges of the arcuate sectors 86 being engaged within the exterior groove of the sleeve 96. In this way, the first movable member 88 is mounted for rotational movement about the axis of the housing wall 62 for movement between first and second limiting positions. The radial edges defining the vector shaped openings 94 limit the movement of the movable member 88 by engagement with the nozzles 74 at each end of the vector shaped opening.

Figure 7:
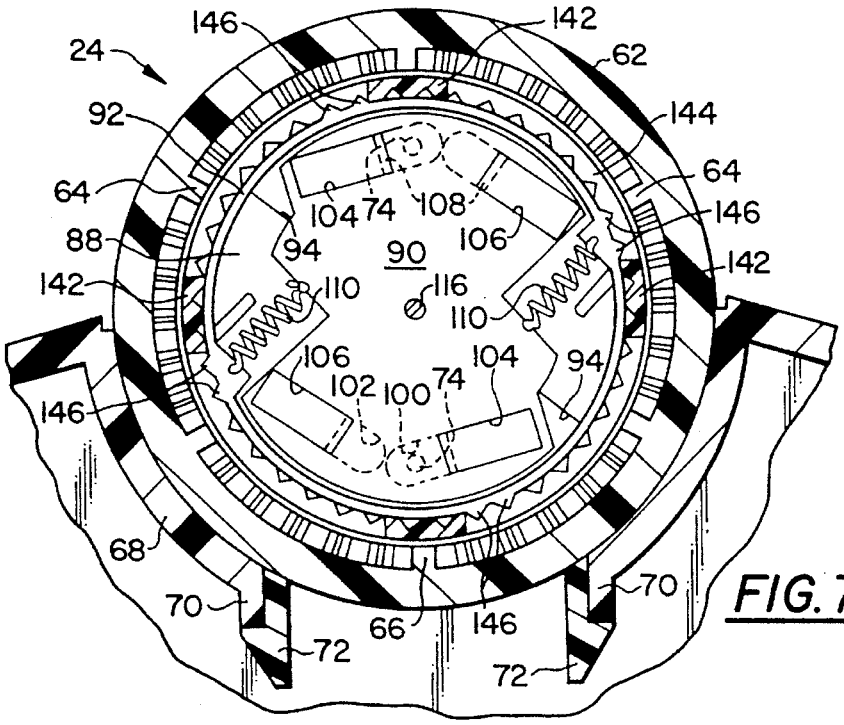
FIG. 7 is an enlarged fragmentary sectional view taken along the line 7—7 of FIG. 3.

As best shown in FIGS. 3 and 7, the cooperating second movable member 90 is mounted within the peripheral wall 92 of the first movable member 88. The second movable member 90 includes a split hub 98 which is adapted to extend through the sleeve 96 of the first movable member 88 and to snap therein. The split hub 98 serves to mount the second movable member 90 for movement about the axis of the housing wall 62 between first and second limiting positions. Formed in the second movable member 90 in positions to receive the axially extending jet formation of water issuing from the nozzles 74 are pairs of generally right angle arcuate surfaces 100 and 102, respectively. Each pair of arcuate surfaces 100 and 102 are oppositely directed and extend from one position tangentially in opposite directions. Each pair of arcuate surfaces 100 and 102 extends to a pair of openings 104 and 106 extending tangentially therefrom which are formed in the second movable member 90. Extending from the walls defining the adjacent ends of each pair of openings are stop walls 108 which engage the associated nozzle 74 and determine the first and second positions of the second movable member 90.

Connected between the first movable member 88 and the cooperating second movable member 90 is a pair of compression coil springs 110 having radially extending ends which are engaged in grooves respectively in the first and second movable members 88 and 90. The springs 110 serve to both hold the movable members into their limiting positions thereof and have an over center biasing action with respect to the second movable member 90 while the first movable member is moved. Thus, the springs 110 bias the second movable member 90 to remain in the first position thereof when the first movable member 88 is biased thereby in the first position thereof. The springs 110 bias the second movable member 90 to move from the first position thereof into the second position thereof when the first movable member 88 is moved from the first position thereof into the second position thereof. Thereafter, the springs 110 bias the second movable member 90 to remain in the second position thereof when the first movable member 88 is biased thereby in the second position thereof. Finally, the springs 110 bias the second movable member 90 to move from the second position thereof into the first position thereof when the first movable member 88 is moved from the second position thereof into the first position thereof.

It will also be noted that in the first position of the second movable member 90 the jet streams issuing from the nozzles 74 are directed tangentially by arcuate surfaces 100 through openings 104 in a first direction onto an impeller 112 to rotate the impeller 112 in one direction about the rotational axis thereof. When the second movable member 90 is moved into the second position thereof, the jet streams issuing from the nozzles 74 are directed tangentially by arcuate surfaces 102 through openings 106 in a second direction onto the impeller 112 to rotate the impeller 112 in a second and opposite direction about the rotation axis thereof.

Figure 8:
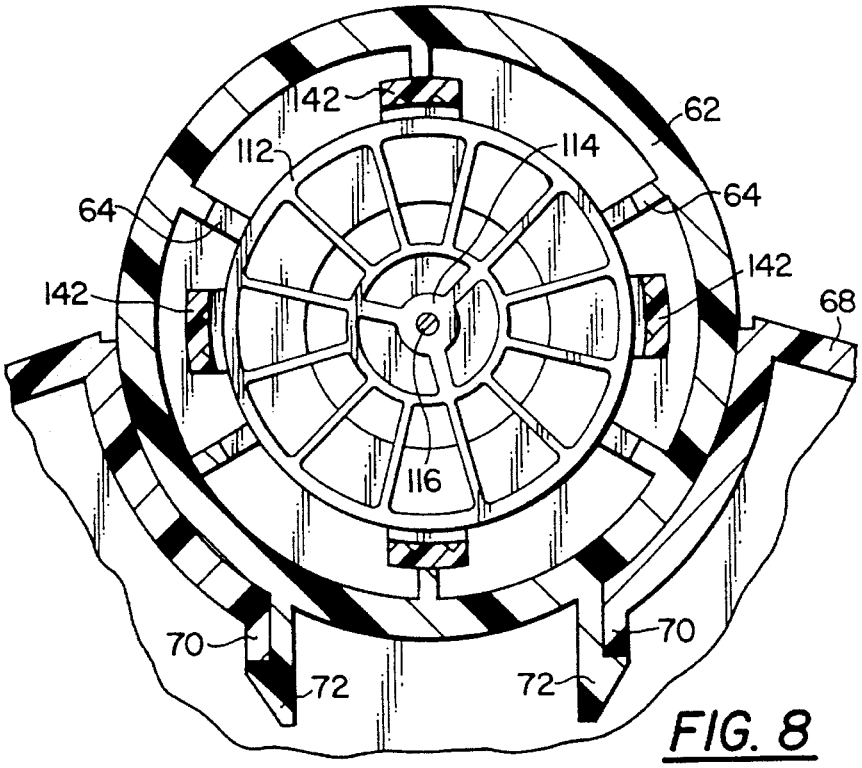
FIG. 8 is an enlarged fragmentary sectional view taken along the line 8—8 of FIG. 3.

As best shown in FIGS. 3 and 8, the impeller 112 includes a hub 114 which is journalled on a shaft 116 extending through the split hub 96 of the second movable member. The impeller 112 may be of any suitable construction and as shown is a unitary plastic molding including an inner annular wall which is connected to the hub 114 by ribs and a series of radially extending impeller blades which are integral with a peripheral wall. Extending inwardly from the peripheral wall is an annular wall which also connects the blades but allows for passage of water axially through the impeller 112 after having impinged on the blades thereof.

The hub 114 of the impeller 112 extends downstream and has teeth formed on the end portion thereof defining a sun gear 117 forming a part of a planetary gear assembly, generally indicated at 118. The sun gear 117 forms a part of a first stage of the planetary gear assembly 118 which also includes a pair of planetary gears 120 meshing with the sun gear 117 and a ring gear 122 meshing with the planetary gears 120. The planetary gears 120 are journalled on shafts of a carrier 124 journalled on shaft 116 which includes an integral second stage sun gear 126. The ring gear 122 is extended axially to form a part of the second stage and a pair of second stage planetary gears 120 complete the second stage. As before, the planetary gears 120 are journalled on shafts of a carrier 124 which also includes an integral third stage sun gear 117 journalled on the shaft 116.

The third stage includes a ring gear 128 which is formed integrally as a part of the peripheral wall 62, being integrally interconnected with the radially inward ends of the ribs 64 near the outlet end of the wall 62. The third stage also includes three planetary gears 130 which mesh with the sun gear 117 and ring gear 128. The planetary gears 130 are journalled on shafts of a carrier 132 which includes a forwardly extending output shaft 134. The output shaft 134 is journalled within a sleeve 136 which has a frustoconical wall extending therefrom to the ring gear all of which forms an integral part of the housing wall 62. The output shaft 134 is held in place by a washer and the portion of the output shaft which extends therebeyond is formed into four separate annularly spaced projections 138, each of a square cross sectional configuration defining a square-shaped opening therewithin.

It will be noted that the downstream end of the central shaft 116 terminates within the output carrier shaft 134 and is knurled to be fixed therein so as to move through repeated oscillating cycles therewith. In addition, the output shaft 138 is also connected with the sprinkler spray head assembly 14, preferably through a slip clutch connecting member, generally indicated at 140, so as to be moved through repeated oscillating cycles therewith. As previously indicated, the cycle stroke distance is determined by the setting of the stop system or adjusting mechanism 58.

While in its broadest aspects the present invention contemplates a conventional adjusting mechanism capable of creating a reversing movement at the end of each stroke which is transmitted to the first movable member 58 to reverse the drive direction; in the preferred embodiment shown, the adjusting mechanism 58 functions to simply stop the movement of the sprinkler spray head assembly 14 at the end of each stroke. Stopping the movement of the sprinkler head assembly 14 also stops the movement of the third stage of the planetary gear assembly 18, however, it does not stop the impeller 112 from moving since the water continues to flow. As the impeller 112 continues to move, the sun gear 116 will turn first stage planetary gears 120 causing the first stage carrier 124 to move, thus moving second stage sun gear 117. Rotation of the second stage sun gear 117 causes the second stage planetary gears 120 to rotate, but since third stage sun gear 117 is stopped the second stage carrier 124 integral therewith, likewise cannot move. Hence, the second stage planetary gears 120 will tend to be rotated about stationary shafts and this rotation is possible since the meshing ring gear 122 is not rigidly fixed. Instead, ring gear 122 is allowed to move and this movement is transmitted to the first movable member 88 to effect a reversal of the impeller 112 to begin the next stroke in the opposite direction. The motion of the ring gear 122 is transmitted to the first moving member 88 by a direct connection which, like the rib 64 in trough 66 mount of the end member 60, can accommodate any angular position of the end member 60.

As best shown in FIGS. 3, 7 and 8, four annularly spaced arms 142 are formed integrally on the ring gear 122 and extend axially therefrom in an upstream direction. An interiorly serrated ring 144 is integrally attached to the upstream ends of the arms 142. The ring 144 extends around the peripheral wall 92 of the first movable member 88. As best shown in FIG. 7, the peripheral wall has four pairs of teeth 146 spaced around the exterior thereof which enter between the interior serrations of the ring 144 to insure that movement of the ring gear 122 about the axis of shaft 116 will be transmitted to the first movable member 88.

Figure 9:
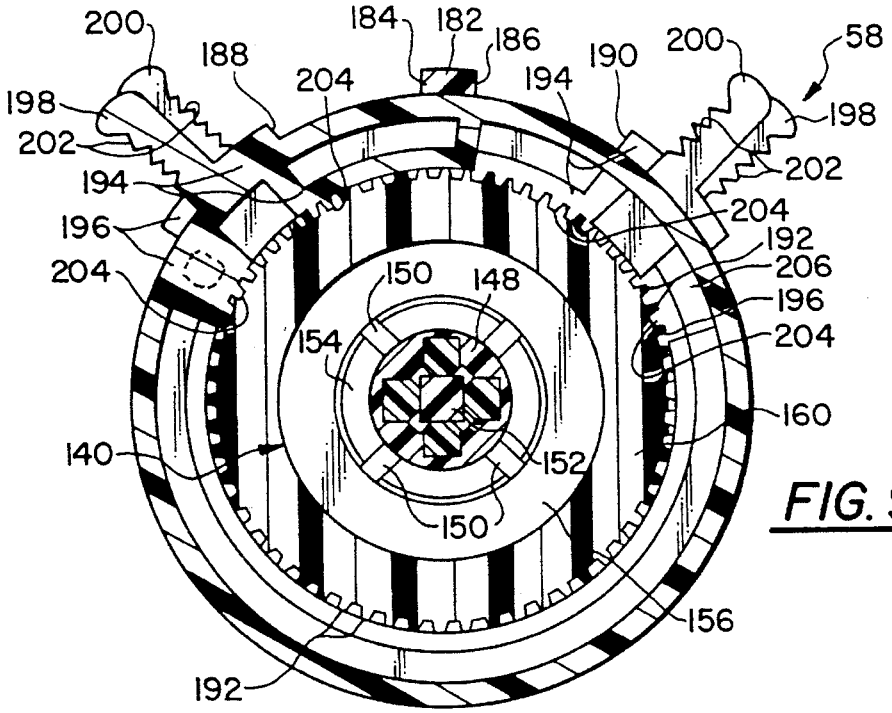
FIG. 9 is an enlarged sectional view taken along the line 9—9 of FIG. 3.
Figure 10:
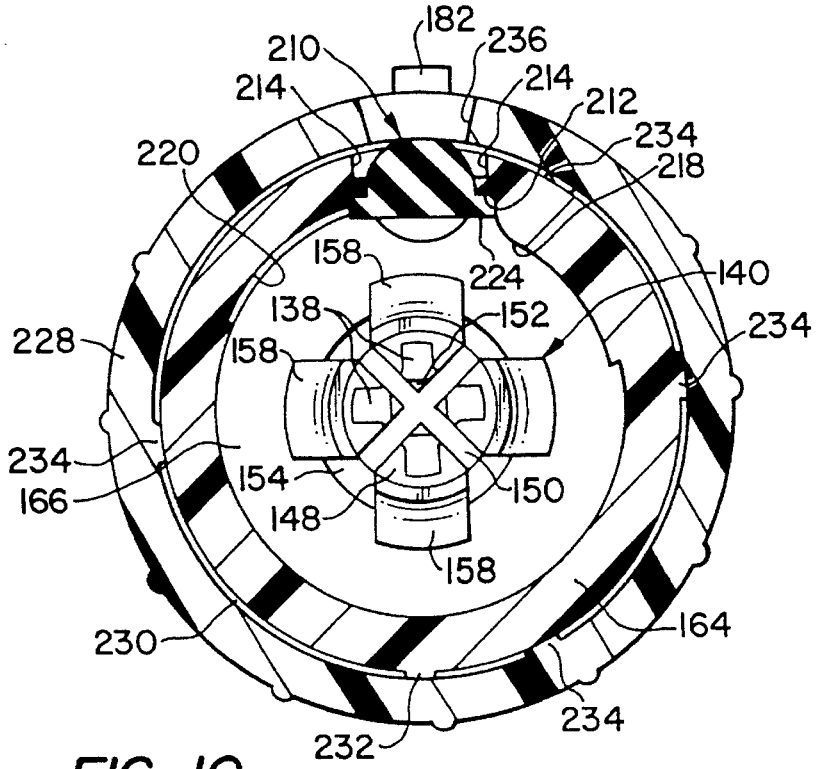
FIG. 10 is an enlarged sectional view taken along the line 10—10 of FIG. 3.
Figure 11:
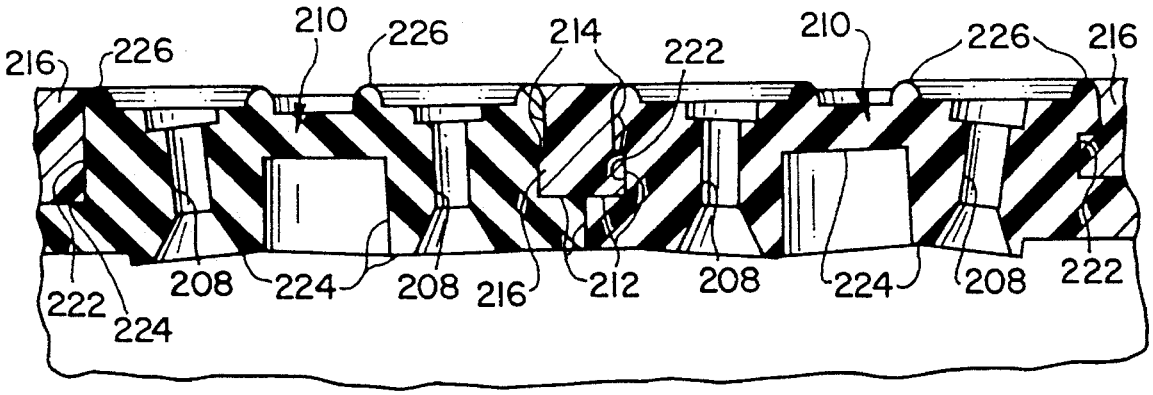
FIG. 11 is a greatly enlarged fragmentary sectional view taken along the line 11—11 of FIG. 2.

Referring now more particularly to FIGS. 3, 9 and 10, the upstream end of the connector member 140 includes a circular portion 148 which is shaped to receive the four projections 138. The circular portion 148 is integrally connected with four annularly spaced ribs 150 which carry a central projection 152 of square-shaped cross-sectional configuration adapted to interfit with the four projections 138. The ribs 150 are integral exteriorly with the main sleeve-like body 154 having an exterior flange 156 at an upstream end. The main body 154 of the connector member 140 is formed with a pair of annular grooves in its exterior periphery. In the downstream end portion thereof, which is of a lesser diameter, an exterior flange is formed on the exterior periphery thereof and the downstream end portion is slotted so as to provide four arcuate prong-like elements 158.

A tubular outlet housing closure member 160 of the second housing assembly 24 is mounted within the outlet end of the housing wall 62 in fixed relation, as by welding or the like, to define the outlet 28 of the second housing assembly 24. The closure member 160 includes an interior annular shoulder which faces upstream and an O-ring seal 162 is provided between this shoulder and the exterior upstream flange 156 on the connecting member 140 so as to ensure that all of the water under pressure flowing toward the outlet 28 of the second housing assembly 24 will flow through the connector member 140.

From the above, it can be seen that the connector member 140 is mounted for rotation with the output shaft 134 of the planetary gear assembly 56 through repeated oscillating cycles therewith. The downstream portion of the connector member 140 extending outwardly from the closure member 160 is adapted to mount the upstream end of the tubular sprinkler spray head assembly 14 for normal movement therewith. In this regard, it will be noted that the sprinkler spray head assembly 14 includes an elongated tubular head member 164 having an annular wall 166 extending radially inwardly from the upstream end thereof at a position spaced inwardly from the upstream extremity. Extending in an upstream direction from the annular wall 166 at a position outwardly from the interior inner periphery thereof is a cylindrical wall portion 168.

The tubular head member 164 is adapted to be connected to the connecting member 140 by simply moving the same axially over the prong-like elements 158 at the downstream end of the connecting member 140 until the inner periphery of the annular wall 166 engages behind the flanges of the elements 58 which flex to permit the achievement of the connection with a snap action. It will be noted that a pair of O-rings 170 are mounted within the annular grooves in the main body 154 of the connecting member 140 so as to engage the interior of the cylindrical wall portion 168. The friction of the O-rings 170 on the wall portion 168 and the gripping action of the prong-like elements 158 with the annular wall 166 normally maintain the tubular head member 164 in a fixed operative relation with respect to the connecting member 140 so that the tubular head member 164 will be oscillated as the connecting member 140 is oscillated. However, the connection will slip in the event that an undesired manual rotation is imparted to the tubular head member 164 which is incapable of being fed back through the planetary gear assembly 56.

As best shown in FIG. 2, the downstream end of the tubular head member 164 is open and is adapted to be closed by an annular closure member 172 which is rotatably supported on an upright base member 174 forming a part of the base assembly 30. The closure member 172, as shown in FIG. 2, has a removable plug 176 therein. The base member 174 is interconnected with the base member 68 by a pair of metal tubes 178. The ends of the tubes 178 are connected by staking them transversely into hollow wall sections 180 forming a part of the base members 68 and 174 extending into the open ends of the tubes. (See FIG. 2.)

The upstream end of the tubular head member 164 has an arm 182 formed on the exterior periphery thereof in radially outwardly extending relation. The arm 182 extends in an axial upstream direction beyond the upstream extremity of the tubular head member 164. The arm 182 provides first and second stop surfaces 184 and 186 which are adapted to engage first and second stop surfaces 188 and 190, respectively, provided by the adjusting mechanism 58.

In the broadest aspects of the present invention, the adjusting mechanism 58 can assume any well-known configuration. However, a preferred embodiment is in the form of two stop or adjustment rings of substantially identical construction mounted in side-by-side mirror image relationship with respect to one another around an annular section of the housing closure member 160 which has a series of serrations 192 formed on the exterior periphery thereof.

As best shown in FIGS. 1, 2 and 9, each adjustment ring 58 is split so as to define a pair of side-by-side end portions 194 and 196 having a pair of pinching elements 198 and 200, respectively, fixed thereto and extending outwardly therefrom so as to present oppositely facing digital engaging surfaces 202.

As best shown in FIG. 9, the end portions 194 and 196 also provide a pair of short arcuate sections having serrations 204 on the interior thereof adapted to mesh with or interengage with the serrations 192 on the closure member 160. The end portions 194 and 196 are split in an axial direction so that the width of an outer end portion 194 is greater than the width of the inner end portion 196. The outer end portion 194 which has the larger width also extends arcuately to a greater extent than the inner end portion 196. The short inner end portion 196 has a stop element 206 extending axially therefrom. The remainder of each ring 58 which extends through approximately 330° of the ring has a generally U-shaped cross-sectional configuration in which the bight of the U is a radial wall, and the legs of the U are of unusual length. The shorter leg constitutes an interior axial wall and a larger peripheral wall. It will also be noted that first and second stop surfaces 188 and 190 are on end portions 194 and extend above the peripheral wall of the rings in a position to be engaged by the arm surfaces 184 and 186, respectively.

The construction of the first and second rings 58 is such that each can be moved from any selected first or second adjustment position respectively to any other selected first or second adjustment position respectively within first or second ranges of adjustment position respectively. The interengagement of the stop member elements 206 with the inner arcuate end of the associated end portion 194 is such that the lower limit of the range of the first and second adjustment positions is predetermined, as for example 30° apart. Movement of each ring 58 is accomplished by first digitally engaging the digital-engaging surfaces 202 of the associated pinching elements 198 and 200, then pinching the digital-engaging surfaces 202 toward one another which has the effect of enlarging the interior circumference of the associated ring 58 and displacing the associated inwardly facing serrations 204 with respect to the outwardly facing serrations 192 of the housing closure member 160. Thereafter, the associated ring 58 is moved from the selected adjustment position it is in arcuately in the appropriate direction into the other selected position while retaining the associated pinching elements 198 and 200 in pinched relation. Thereafter, they are released to enable the inherent resiliency of the ring 58 to engage the associated inwardly facing serrations 204 in meshing relation with the engaged outwardly facing serrations 192 of the housing closure member 160.

Referring now more particularly to FIGS. 1–3, 10 and 11, the sprinkler spray head assembly 14 is provided with a series of openings 208 which allow the water under pressure which is received within the tubular head member 164 to discharge therefrom as a series of streams which fall onto the ground in a predetermined pattern as the sprinkler head assembly 14 moves through repeated oscillating cycles. As previously indicated, each cycle includes a stroke in one direction and a return stroke in the other direction and the distance of the stroke is determined by the setting of the adjustment rings 58. The openings 208 which define the streams issuing from the sprinkler head assembly 14 are constructed in accordance with the principles of the present invention. Specifically, the openings 208 are formed in a pair of elongated strips, generally indicated at 210, suitably molded of rubber-like material. In the embodiment shown, there are two strips 210 of identical configuration provided, although it will be understood that one or more than two such strips may also be utilized. The openings 208 in each strip 210 extend therethrough along an axis which is perpendicular at one end. The axis of each successive opening 208 is inclined slightly more in a direction toward the opposite end from the preceding one. When the two strips 210 are mounted in aligned mirror image relationship with respect to one another, the resultant streams are in a fan-shaped configuration which is desirable for a wave sprinkler. Stated differently, the water stream outlets in each strip are inclined progressively less in a direction from the end of the series so as to form the series of water streams into a fan-shaped spray.

The strips 210 are mounted in an elongated section of the tubular head member 164. As best shown in FIG. 10, the tubular head member 164 is molded of a plastic material to include strip-engaging surfaces 212 of generally wide inverted U-shaped configuration and opening-defining surfaces 214 of a stepped cross-sectional configuration so that each opening is formed with a flange at its lower portion. As best shown in FIG. 1, the openings defined by surfaces 214 are disposed in axial alignment and spaced slightly apart by short transversely extending portions 216 of the tubular head member 164. Preferably, the walls on opposite sides of the openings and portions 216 are formed with different thicknesses. Thus, as shown in FIG. 10, the wall has an added dimension thereto as indicated at 218, while on the opposite side, the wall has a recess therein, as indicated at 220. This configuration ensures that, as the molding takes place, the molten plastic material which enters the mold cavity will flow across the spaces in the mold which define the short portions 216 from the thick side 218 to the thin side 220. This construction ensures that the merger of the plastic material will occur at the thin side 220 rather than in the middle of the short portions 216 as would be the case if the two wall thicknesses were the same. If the plastic material is allowed to meet in the center of the short portions 216, short portions 216 would be of reduced strength and subject to possible fracture which is not the case with the present construction where the juncture would occur along the recessed wall thickness 220.

The axial dimension of each opening defined by surfaces 214 is of a size to receive two adjacent strip openings 208 extending through the strip 210. Each strip 210 includes exterior mounting surfaces 222 which engage the strip-engaging and opening-defining surfaces 212 and 214 of the tubular head member 164. Preferably, these mounting surfaces 222 are such as to extend or snap over the opening flanges defined by surfaces 214 when the strip 210 is extended into the end of the tubular head member 164 and moved radially outwardly through the openings defined by surfaces 214. Each strip 210 also includes interior pressure responsive surfaces 224 and integral exterior O-rings 226 which extend around each opening 208. It can be seen that, in operation, the pressure applied by the water under pressure within the tubular head member 164 acting on the pressure responsive surfaces 224 of each strip 210 serves to enhance the engagement of the mounting surfaces 222 thereof with the interior strip-engaging surfaces 212 of the tubular head member 164.

The O-rings 226 of each strip 210 are adapted to extend slightly beyond the peripheral surface of the tubular head member 164 and, in accordance with the principles of the present invention, there is provided a pair of tubular control members 228 movably mounted over opposite ends of the tubular head member 164 for movement into a plurality of adjustment positions enabling the operator to vary the width of the fan-shaped spray configuration which issues from the openings 208. The tubular control members 228 are of cylindrical construction and mounted in mirror image relation with respect to one another. In this regard, it will be noted that the interior of each tubular control member 228 is formed with an inwardly extending flange 230 at an outer end thereof. The tubular head member 164 is formed with a narrow rib 232 which extends axially thereon from a position spaced slightly inwardly from each end thereof. The ends of the rib 232 engage flanges 230 to retain the control members 228 axially. The free surface of the rib 232 engages an interior periphery of each control member 228 which has an interior diameter slightly greater than the exterior diameter of the tubular head member 164. The positioning of the axial rib 232 opposite from the elongated section which receives the strips 210 ensures that the opposite side of each control member overlying the strips 210 will be biased radially inwardly.

The interior surface of each tubular control member 228 also is provided with four annularly spaced ribs 234 which slidably engage the exterior periphery of the tubular head member 164 between the lower rib 232 thereof and the opposite surface thereof. Each tubular control member 228 has a portion thereof which constitutes four side-by-side control sections, the axial width of the control sections being slightly greater than the diameter of an O-ring 226 and the arcuate extent being slightly greater than four times the diameter of an O-ring. The control section of each control member which is nearest the adjacent end of the tubular head member 164 has an opening 236 therein which is extends arcuately a distance slightly greater than the diameter of one O-ring 226. The next adjacent control section has an opening 238 aligned with the first opening but with an axial extent which is approximately twice the axial extent of the first. The next has an opening 240 which communicates with the preceding opening but with an axial extent of three times the original size and, finally, the next adjacent control section has an opening 242 which is approximately four times the diameter of an O-ring 226.

It can be seen that, when each tubular control member 228 is rotated to the position shown in which the associated four strip openings 208 are aligned with the openings 236, 238, 240 and 242 in the tubular control member 228, water under pressure within the tubular head member 164 will issue from all of the openings, thus presenting a full fan-shaped spray configuration.

When a tubular control member 228 is turned axially an extent generally equal to the diameter of an O-ring 226, the first control section engages the O-ring 226 of the endmost strip opening 208 to close off the stream issuing therefrom. An additional incremental rotational movement of an arcuate extent slightly greater than an O-ring diameter will bring the second control section into engagement with the second O-ring 226 to close off the stream from the associated strip opening 208. Two more incremental movements of similar axial extent will result in the close-off of the streams issuing from the third and fourth openings 208 from the end of the associated strip 210. By providing a tubular control member 228 at each end, it is possible for the operator to change the spread of the fan-shaped spray into eight different incremental widths by alternately moving each of the control members 228 through an arcuate extent slightly greater than the diameter of an O-ring 226 in succession. Alternatively, either end of the fan-shaped spray pattern can be shortened by moving the associated control member 228 for that end.

Any United States patent applications or patents mentioned or cited hereinabove are hereby incorporated by reference into the present specification.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A wave sprinkler assembly comprising a housing and base assembly providing a water inlet for communication with a source of water under pressure and an outlet communicating with said inlet, a tubular spray assembly mounted on said housing and base assembly for oscillatory movement with respect thereto, said tubular spray assembly having an inlet end disposed in sealed water communicating relation with said outlet so that an interior of said tubular spray assembly receives water under pressure from said outlet, a closed end and a series of longitudinally spaced water stream outlets between said inlet end and said closed end, an oscillating mechanism carried by said housing and base assembly constructed and arranged to be operable by water flowing between said water inlet and said outlet to oscillate said tubular spray assembly when said water inlet is communicated with a source of water under pressure, said tubular spray assembly including a tubular member and an elongated strip of flexible material having a number of said series of longitudinally spaced water stream outlets extending therethrough, said tubular member including an elongated section having transverse opening-defining and interior strip-engaging surfaces thereon, said strip having interior pressure responsive and exterior mounting surfaces therein constructed and arranged so that when said strip is inserted within said tubular member through an end thereof and moved radially outwardly into an operative position with respect to said elongated section of said tubular member the interior pressure responsive and exterior mounting surfaces of said strip are engaged respectively (1) by the water under pressure within the interior of said tubular spray assembly and (2) by an interior-strip engaging surface of said tubular member so that engagement of the water under pressure with the strip enhances engagement of the strip with the tubular member, each water stream outlet in said strip extending within an opening in said tubular member defined by an opening-defining surface of said tubular member so that water under pressure within the interior of said tubular spray assembly issues from said series of longitudinally spaced water stream outlets as a series of longitudinally spaced water streams which oscillate as the tubular spray assembly is oscillated to provide a desired sprinkler pattern on a ground area to be sprinkled, said tubular spray assembly including a second elongated strip of flexible material having a number of said series of longitudinally spaced water stream outlets extending therethrough, said second strip having interior pressure responsive and exterior mounting surfaces therein constructed and arranged so that when said second strip is inserted within said tubular member through an end thereof and moved radially outwardly into an operative position with respect to said elongated section of said tubular member the interior pressure responsive and exterior mounting surfaces of said second strip are engaged respectively (1) by the water under pressure within the interior of said tubular spray assembly and (2) by an interior strip-engaging surface of said tubular member so that engagement of the water under pressure with the strip enhances engagement of the strip with the tubular member, each water stream outlet in said second strip extending within an opening in said tubular member defined by an opening-defining surface of said tubular member so that water under pressure within the interior of said tubular spray assembly issues from said series of longitudinally spaced water stream outlets as a series of longitudinally spaced water streams which oscillate as the tubular spray assembly is oscillated to provide a desired sprinkler pattern on a ground area to be sprinkled, the number of water stream outlets in each of said strips constituting half of the series of water stream outlets, said water stream outlets in each strip being arranged in adjacent pairs, each adjacent pair extending within a separate opening in said tubular member defined by a transverse opening-defining surface of said tubular member, said tubular member being molded of plastic material with the elongated section having a thickness on one side of the openings therein greater than a thickness on an opposite side thereof so that in the molding operation the plastic material flows between the openings from the one side of greater thickness to the opposite side.

2. A wave sprinkler assembly comprising a housing and base assembly providing a water inlet for communication with a source of water under pressure and an outlet communicating with said inlet, a tubular spray assembly mounted on said housing and base assembly for oscillatory movement with respect thereto, said tubular spray assembly having an inlet end disposed in sealed water communicating relation with said outlet so that an interior of said tubular spray assembly receives water under pressure from said outlet, a closed end and a series of longitudinally spaced water stream outlets between said inlet end and said closed end, an oscillating mechanism carried by said housing and base assembly constructed and arranged to be operable by water flowing between said water inlet and said outlet to oscillate said tubular spray assembly when said water inlet is communicated with a source of water under pressure, said tubular spray assembly including a tubular member and an elongated strip of flexible material having a number of said series of longitudinally spaced water stream outlets extending therethrough, said tubular member including an elongated section having transverse opening-defining and interior strip-engaging surfaces thereon, said strip having interior pressure responsive and exterior mounting surfaces therein constructed and arranged so that when said strip is inserted within said tubular member through an end thereof and moved radially outwardly into an operative position with respect to said elongated section of said tubular member the interior pressure responsive and exterior mounting surfaces of said strip are engaged respectively (1) by the water under pressure within the interior of said tubular spray assembly and (2) by an interior-strip engaging surface of said tubular member so that engagement of the water under pressure with the strip enhances engagement of the strip with the tubular member, each water stream outlet in said strip extending within an opening in said tubular member defined by an opening-defining surface of said tubular member so that water under pressure within the interior of said tubular spray assembly issues from said series of longitudinally spaced water stream outlets as a series of longitudinally spaced water streams which oscillate as the tubular spray assembly is oscillated to provide a desired sprinkler pattern on a ground to be sprinkled, the number of water stream outlets in said strip includes a plurality of controllable water stream outlets at one end of said series, said strip providing an annular seal of flexible sealing material extending around an exterior of each of said controllable water stream outlets, and a control member mounted on said elongated tubular assembly for movement with respect to said elongated tubular assembly in opposite directions between a full width operating position and a width limiting position, said control member including a control section associated with each annular seal and the controllable water stream outlet around which it extends, each control section extending in the direction of movement of said control member and having a surface area movable into engagement with the associated annular seal to prevent a water stream from issuing from the controllable water stream outlet around which it extends and an open area movable over the controllable water stream outlet around which the associated annular seal extends to allow a water stream to issue therefrom.

3. A wave sprinkler assembly as defined in claim 2 wherein said tubular spray assembly includes a second elongated strip of flexible material having a number of said series of longitudinally spaced water stream outlets extending therethrough, said second strip having interior pressure responsive and exterior mounting surfaces therein constructed and arranged so that when said second strip is moved into an operative position with respect to said elongated section of said tubular member the interior pressure responsive and exterior mounting surfaces of said second strip are engaged respectively (1) by the water under pressure within the interior of said tubular spray assembly and (2) by an interior strip-engaging surface of said tubular member so that engagement of the water under pressure within the strip enhances engagement of the strip with the tubular member, each water stream outlet in said second strip extending within an opening in said tubular member defined by an opening-defining surface of said tubular member so that water under pressure within the interior of said tubular spray assembly comes from said series of longitudinally spaced water stream outlets as a series of longitudinally spaced water streams which oscillate as the tubular spray assembly is oscillated to provide a desired sprinkler pattern on a ground area to be sprinkled.

4. A wave sprinkler assembly as defined in claim 3 wherein the number of water stream outlets in said second strip includes a corresponding plurality of second controllable water stream outlets at an opposite end of said series, said second strip providing a second annular seal of flexible sealing material extending around an exterior of each of said second controllable water stream outlets, and a second control member mounted on said tubular spray assembly for movement with respect to said tubular spray assembly in opposite directions between a full width operating position and a width limiting position, said second control member including a second control section associated with each second annular seal and the second controllable water stream outlet around which it extends, each second control section extending in the direction of movement of said second control member and having a second surface area movable into engagement with the associated second annular seal to prevent a water stream from issuing from the second controllable water stream outlet around which it extends and a second open area movable over the second controllable water stream outlet around which the associated second annular seal extends to allow a water stream to issue therefrom.

5. A wave sprinkler assembly as defined in claim 4 wherein said tubular member has a generally cylindrical exterior periphery, said control member being of sleeve-like configuration molded of plastic material mounted in surrounding relation to an exterior periphery of said tubular member for limited arcuate movement in opposite directions about an axis of said cylindrical exterior periphery between said full width and limited width positions, said control sections comprising adjacent arcuate sections of said control member, the arcuate extent of an open area of each arcuate control section being greater than an arcuate extent of the open area of the arcuate control section adjacent thereto in a direction extending away from the arcuate control section associated with the annular seal extending around the controlled water stream outlet at said one end of said series.

6. A wave sprinkler assembly as defined in claim 5 wherein said control member has a generally cylindrical interior periphery slightly greater than a cylindrical exterior periphery of said tubular member so as to extend therearound in spaced relation, an outwardly extending axial ridge on the exterior periphery of said tubular member opposite said strip, and a plurality of inwardly extending axial ridges on the interior of said control member maintaining the interior periphery and exterior periphery in spaced relation while permitting said arcuate movement of said control member.

7. A wave sprinkler assembly comprising a housing and base assembly providing a water inlet for communication with a source of water under pressure and an outlet communicating with said inlet, a tubular spray assembly mounted on said housing and base assembly for oscillatory movement with respect thereto, said tubular spray assembly having an inlet end disposed in sealed water communicating relation with said outlet so that an interior of said tubular spray assembly receives water under pressure from said outlet, a closed end and a series of longitudinally spaced water stream outlets between said inlet end and said closed end, an oscillating mechanism carried by said housing and base assembly constructed and arranged to be operable by water flowing between said water inlet and said outlet to oscillate said tubular spray assembly when said water inlet is communicated with a source of water under pressure, said tubular spray assembly including a tubular member and an elongated strip of flexible material having a number of said series of longitudinally spaced water stream outlets extending therethrough, said tubular member including an elongated section having transverse opening-defining and interior strip-engaging surfaces thereon, said strip having interior pressure responsive and exterior mounting surfaces therein constructed and arranged so that when said strip is inserted within said tubular member through an end thereof and moved radially outwardly into an operative position with respect to said elongated section of said tubular member the interior pressure responsive and exterior mounting surfaces of said strip are engaged respectively (1) by the water under pressure within the interior of said tubular spray assembly and (2) by an interior-strip engaging surface of said tubular member so that engagement of the water under pressure with the strip enhances engagement of the strip with the tubular member, each water stream outlet in said strip extending within an opening in said tubular member defined by an opening-defining surface of said tubular member so that water under pressure within the interior of said tubular spray assembly issues from said series of longitudinally spaced water stream outlets as a series of longitudinally spaced water streams which oscillate as the tubular spray assembly is oscillated to provide a desired sprinkler pattern on a ground area to be sprinkled, said tubular spray assembly including a second elongated strip of flexible material having a number of said series of longitudinally spaced water stream outlets extending therethrough, said second strip having interior pressure responsive and exterior mounting surfaces therein constructed and arranged so that when said second strip is inserted within said tubular member through an end thereof and moved radially outwardly into an operative position with respect to said elongated section of said tubular member the interior pressure responsive and exterior mounting surfaces of said second strip are engaged respectively (1) by the water under pressure within the interior of said tubular spray assembly and (2) by an interior strip-engaging surface of said tubular member so that engagement of the water under pressure with the strip enhances engagement of the strip with the tubular member, each water stream outlet in said second strip extending within an opening in said tubular member defined by an opening-defining surface of said tubular member so that water under pressure within the interior of said tubular spray assembly issues from said series of longitudinally spaced water stream outlets as a series of longitudinally spaced water streams which oscillate as the tubular spray assembly is oscillated to provide a desired sprinkler pattern on a ground area to be sprinkled, the number of water stream outlets in each of said strips constituting half of the series of water stream outlets, said water stream outlets in each strip being arranged in adjacent pairs, each adjacent pair extending within a separate opening in said tubular member defined by a transverse opening-defining surface of said tubular member, the water stream outlets in each strip being inclined progressively less in a direction from the end of the series so as to form the series of water streams into a fan shaped spray, said housing and base assembly including a first tubular housing assembly having said inlet at one end thereof and an opposite outlet end, a second tubular housing having said outlet at one end thereof and an opposite inlet end disposed in sealed water communicating relation with the opposite outlet end of said first housing assembly, and a base assembly, said first and second housing assemblies being fixedly mounted on said base assembly, said tubular spray assembly being mounted for oscillatory movement about an oscillatory axis with the inlet end thereof in sealed water pressure communicating relation with said outlet of said second tubular housing assembly, said water pressure actuated oscillating mechanism being mounted in said second tubular housing assembly between the opposite inlet end and said outlet thereof, said first tubular housing assembly having a manually adjustable control mechanism mounted in operable relation therein between said inlet thereof and opposite outlet end thereof constructed and arranged to control a flow of water under pressure from the inlet thereof to the opposite outlet end thereof in accordance with a manual adjustment of said manually adjustable control mechanism.

8. A wave sprinkler assembly as defined in claim 7 wherein each of said first and second housing assemblies and said base assembly includes cooperating mounting elements constructed and arranged to interengage with a snap action when said housing assemblies and said base assembly are moved relatively into operative relation with respect to one another to thereby retain said housing assemblies in a fixed operative position on said base assembly.

9. A wave sprinkler assembly comprising a housing and base assembly providing a water inlet for communication with a source of water under pressure and an outlet communicating with said inlet, a tubular spray assembly mounted on said housing and base assembly for oscillatory movement with respect thereto, said tubular spray assembly including an inlet disposed in sealed water communicating relation with said outlet so as to supply an interior of said tubular spray assembly with water under pressure, a water pressure actuated oscillating mechanism carried by said housing and base assembly between said water inlet and said outlet constructed and arranged to oscillate said tubular spray assembly when said water inlet is communicated with a source of water under pressure, said tubular spray assembly providing a series of water stream outlets constructed and arranged to have water under pressure supplied to the interior of said tubular spray assembly issue therefrom into a series of water streams which are oscillated to produce a desired water pattern on the ground to be sprinkled having a width determined by water stream outlets at the ends of the series, said water stream outlets including a plurality of controllable water stream outlets at one end of said series, an annular seal of flexible sealing material extending around an exterior of each of said controllable water stream outlets, and a control member mounted on said tubular spray assembly for movement with respect to said tubular spray assembly in opposite directions between a full width operating position and a width limiting position, said control member including a control section associated with each annular seal and the controllable water stream outlet which it extends around, each control section extending in the direction of movement of said control member and having a surface area movable into engagement with the associated annular seal to prevent a water stream from issuing from the controllable water stream outlet around which it extends and an open area movable over the controllable water stream outlet around which the associated annular seal extends to allow a water stream to issue therefrom.

10. A wave sprinkler assembly as defined in claim 9 wherein said water stream outlets include a corresponding plurality of second controllable water stream outlets at an opposite end of said series, a second annular seal of flexible sealing material extending around an exterior of each of said second controllable water stream outlets, and a second control member mounted on said tubular spray assembly for movement with respect to said tubular spray assembly in opposite directions between a full width operating position and a width limiting position, said second control member including a second control section associated with each second annular seal and the second controllable water stream outlet which it extends around, each second control section extending in the direction of movement of said second control member and having a second surface area movable into engagement with the associated second annular seal to prevent a water stream from issuing from the second controllable water stream outlet around which it extends and a second open area movable over the second controllable water stream outlet around which the associated second annular seal extends to allow a water stream to issue therefrom.

11. A wave sprinkler assembly as defined in claim 10 wherein said tubular spray assembly includes a tubular member having a generally cylindrical exterior periphery, said control member being of sleeve-like configuration molded of plastic material mounted in surrounding relation to the exterior periphery of said tubular member for limited arcuate movement in opposite directions about an axis of said cylindrical exterior periphery between said full width and limited width positions, said control sections comprising adjacent arcuate sections of said control member, the arcuate extent of an open area of each arcuate control section being greater than an arcuate extent of the open area of the arcuate control section adjacent thereto in a direction extending away from the arcuate control section associated with the annular seal extending around the controlled water stream outlet at said one end of said series.

12. A wave sprinkler assembly as defined in claim 11 wherein said control member has a generally cylindrical interior periphery slightly greater than said exterior periphery so as to extend therearound in spaced relation, an outwardly extending axial ridge on the exterior periphery of said tubular member opposite said strip, and a plurality of inwardly extending axial ridges on the interior periphery of said control member maintaining the peripheries in spaced relation while permitting said arcuate movement of said control member.

13. A wave sprinkler assembly as defined in claim 9 wherein said housing and base assembly includes a first tubular housing assembly having said inlet at one end thereof and an opposite outlet end, a second tubular housing having said outlet at one end thereof and an opposite inlet end disposed in sealed water communicating relation with the opposite outlet end of said first housing assembly, and a base assembly, said first and second housing assemblies being fixedly mounted on said base assembly, said tubular spray assembly being mounted for oscillatory movement about an oscillatory axis with the inlet end thereof in sealed water pressure communicating relation with said outlet of said second tubular housing assembly, said water pressure actuated oscillating mechanism being mounted in said second tubular housing assembly between the opposite inlet end and said outlet thereof, said first tubular housing assembly having a manually adjustable control mechanism mounted in operable relation therein between said inlet thereof and opposite outlet end thereof constructed and arranged to control the flow of water under pressure from the inlet thereof to the opposite outlet end thereof in accordance with the manual adjustment of said manually adjustable control mechanism.

14. A wave sprinkler assembly comprising a housing and base assembly providing a water inlet for communication with a source of water under pressure and an outlet communicating with said inlet, a tubular spray assembly mounted on said housing and base assembly for oscillatory movement with respect thereto, said tubular spray assembly having an inlet end disposed in sealed water communicating relation with said outlet so that an interior of said tubular spray assembly receives water under pressure from said outlet, a closed end and a series of longitudinally spaced water stream outlets between said inlet end and said closed end, an oscillating mechanism carried by said housing and base assembly constructed and arranged to be operable by water flowing between said water inlet and said outlet to oscillate said tubular spray assembly when said water inlet is communicated with a source of water under pressure, said tubular spray assembly including a tubular member and an elongated strip of flexible material having a number of said series of longitudinally spaced water stream outlets extending therethrough, said tubular member including an elongated section having a number of closely spaced axially aligned openings therein, said strip being fixedly mounted with respect to said elongated section of said tubular member with each water stream outlet in said strip extending within an opening in said tubular member defined by an opening defining surface of said tubular member so that water under pressure within the interior of said tubular spray assembly issues from said series of longitudinally spaced water stream outlets as a series of longitudinally spaced water streams which oscillate as the tubular spray assembly is oscillated to provide a desired sprinkler pattern on a ground area to be sprinkled, said tubular member being molded of plastic material with the elongated section having a thickness on one side of the openings therein greater than a thickness on an opposite side thereof so that in the molding operation the plastic material flows between the openings from the one side of greater thickness to the opposite side.

* * * * *